United States Patent [19]

Grunert et al.

[11] 4,288,669

[45] Sep. 8, 1981

[54] ELECTRIC CONTROL DEVICE

[75] Inventors: Kurt A. Grunert; William J. McKean; John E. Grad, all of Beaver, Pa.

[73] Assignee: Westinghouse Electric Corp., Pittsburgh, Pa.

[21] Appl. No.: 95,802

[22] Filed: Nov. 19, 1979

[51] Int. Cl.[3] ..... H01H 9/00

[52] U.S. Cl. ..... 200/281; 200/284

[58] Field of Search ..... 200/281, 284, 286, 280; 335/197

[56] References Cited

U.S. PATENT DOCUMENTS

| | | | |
|---|---|---|---|
| 2,285,928 | 6/1942 | Jensen | 200/284 |
| 3,164,709 | 1/1965 | Gentile | 200/281 |
| 3,296,567 | 1/1967 | Conner et al. | 335/126 |
| 3,320,561 | 5/1967 | Mobarry | 335/197 |
| 3,676,628 | 7/1972 | Kane | 200/280 |
| 4,139,754 | 2/1979 | Hofferberth | 200/284 |

FOREIGN PATENT DOCUMENTS

| | | | |
|---|---|---|---|
| 625331 | 8/1961 | Canada | 200/284 |

*Primary Examiner*—Willis Little

*Attorney, Agent, or Firm*—Benjamin Hudson, Jr.

[57] ABSTRACT

An electric control device is provided by this invention with a new and unique pull-out contact combination. This pull-out arrangement allows the contact assembly to be pulled away from the housing of the control device for visual inspection of the contacts without removing electrical conductors terminated there.

4 Claims, 6 Drawing Figures

ELECTRIC CONTROL DEVICE

BACKGROUND OF THE INVENTION

This invention relates generally to an electric control device which is an improvement of the type disclosed in the application of John P. Conner and Kurt A. Grunert, Ser. No. 369,715 filed May 25, 1964, now U.S. Pat. No. 3,296,567 and is incorporated here by reference.

DESCRIPTION OF THE PRIOR ART

In a contactor of the type disclosed in the aforesaid mentioned U.S. Pat. No. 3,296,567 a terminal strap was mounted on an insulating contact mounting plate upon which the stationary contact was mounted by means of a screw that secured the stationary contact and the terminal strap to the insulating contact mounting plate. There was also mounted on the terminal strip a metal retainer which was held by means of a second screw and said retainer was used to securely hold electrical conductors to the terminal strap by means of applying direct force with the holding screw. The same screws that mechanically secure the terminal strap to the insulating contact mounting plate was also used to provide pressure for the electrical contact between a stationary contact and the terminal strap. Therefore, in order to inspect the stationary contact or to remove the contact it was necessary to also remove the terminal strap and any electrical conductors terminated at the contactor. When inspecting the stationary contact, it is desirable to have the terminating strap remain mounted to the base of the contactor assembly and not completely fall therefrom or to be removed from its operative position.

SUMMARY OF THE INVENTION

In accordance with this invention an electric control device comprises a housing, a control structure supported on the housing, the control device structure comprising a contact combination and an electromagnet for operating the contact combination. The contact combination first comprises a generally U-shaped terminal, the terminal is inserted into the contactor housing such that a insulating contact mounting plate is 200 located in the bight portion of the terminal assembly. The top member of the U-shaped terminal assembly rests upon the insulating mounting plate, said member comprising an elongated slot. A generally U-shaped contact arm is mounted upon the terminal assembly, the bottom member of which has an elongated slot which matches the slot of the terminal assembly. The bottom member of the U-shaped terminal assembly comprises a threaded hole which receives a retainment screw. When the terminal assembly is placed in position, the hole in the bottom member of the assembly is aligned with a hole provided in the insulating contact mounting plate. Once the terminal assembly is inserted into the contactor housing, the assembly being aligned properly with the insulating contact mounting plate, a retainment screw is then passed through the slot in the contact arm, the elongated slot of the terminal assembly, the insulating contact mounting plate, and threaded into the bottom member of the terminal assembly, thus supplying pressure for the electrical connection between the contact arm and the terminal assembly and also securing both to the insulating contact mounting plate. This novel arrangement allows for easy inspection of the contact. By untightening the screw and releasing the bottom member of the terminal assembly, the elongated slot in the contact arm and the terminal assembly allow the terminal to be withdrawn from the insulating contact mounting plate with the contact arm mounted thereon, whereby the contact can be readily inspected, removed, or replaced. The terminal assembly is then pushed back into location and the retainment screw is retightened. This new pull out arrangement provides for no screw removal during contact change, easy access for contact visibility and change, elimination of inserts or other retaining items that increase reliability by reduction of pieces, and requires no additional space in the panel.

This invention provides a stationary contact combination secondly comprising a collar design to hold securely electrical conductors employing a one piece stamping in the form of a modified tube. The collar has an elongated slot which allows it to be placed on the top member of the terminal assembly prior to insertion on the insulating contact mounting plate. Conductors are held by a convolute opening in the tube with force being applied by a holding screw. This novel configuration produces a mechanical advantage to interlock the conductor by means of pressure applied by the holding screw and confining the cable within the convolute opening.

DESCRIPTION OF THE PREFERRED EMBODIMENTS

Figure 1:
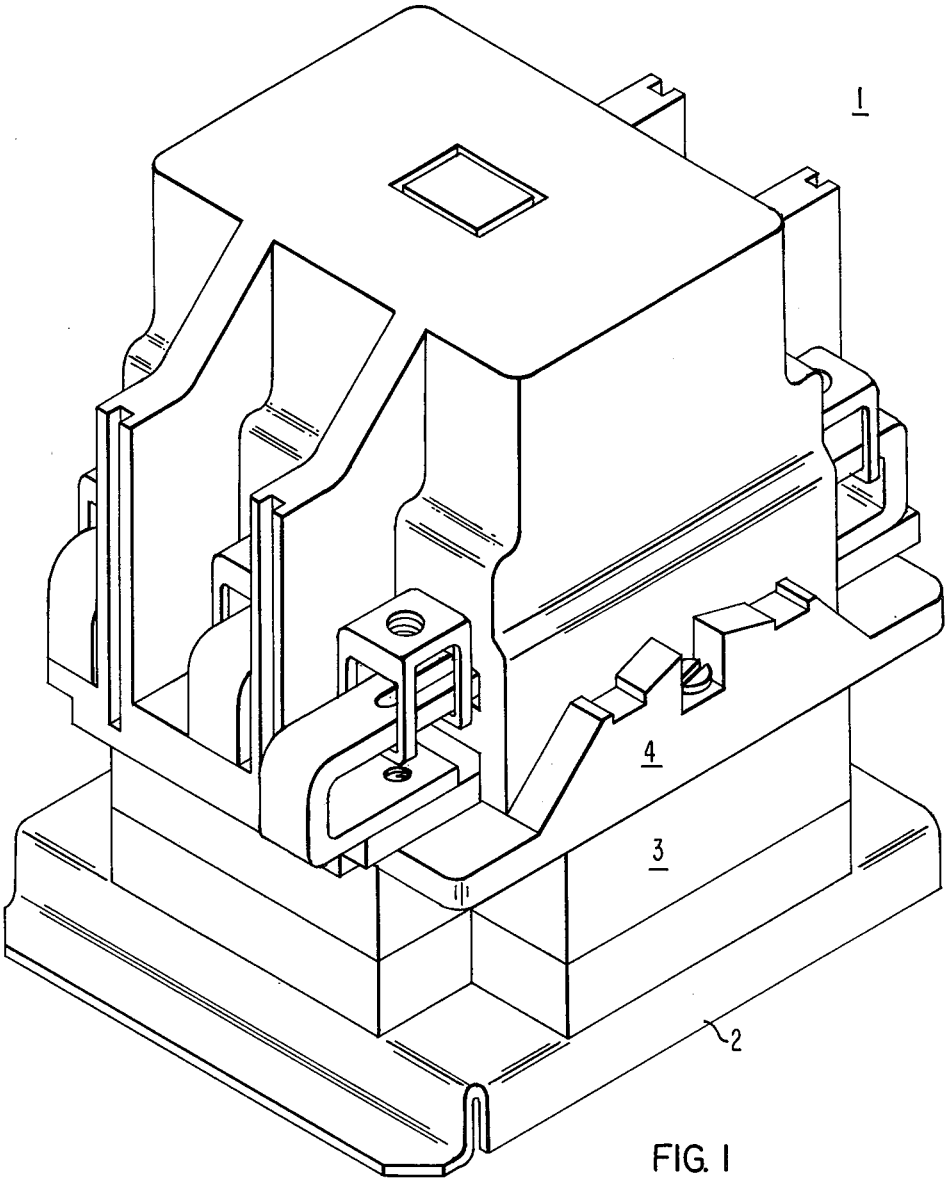
FIG. 1 shows a perspective view of an electric control device.

Referring to FIG. 1, there is shown an electric control device 1 of the type disclosed in the aforesaid mentioned U.S. Pat. No. 3,296,567 which is incorporated here by reference comprising a base 2, an insulated control device structure being comprised of a contact combination 4 and an electromagnetic operating mechanism 3 for operating said contact combination.

Figure 2:
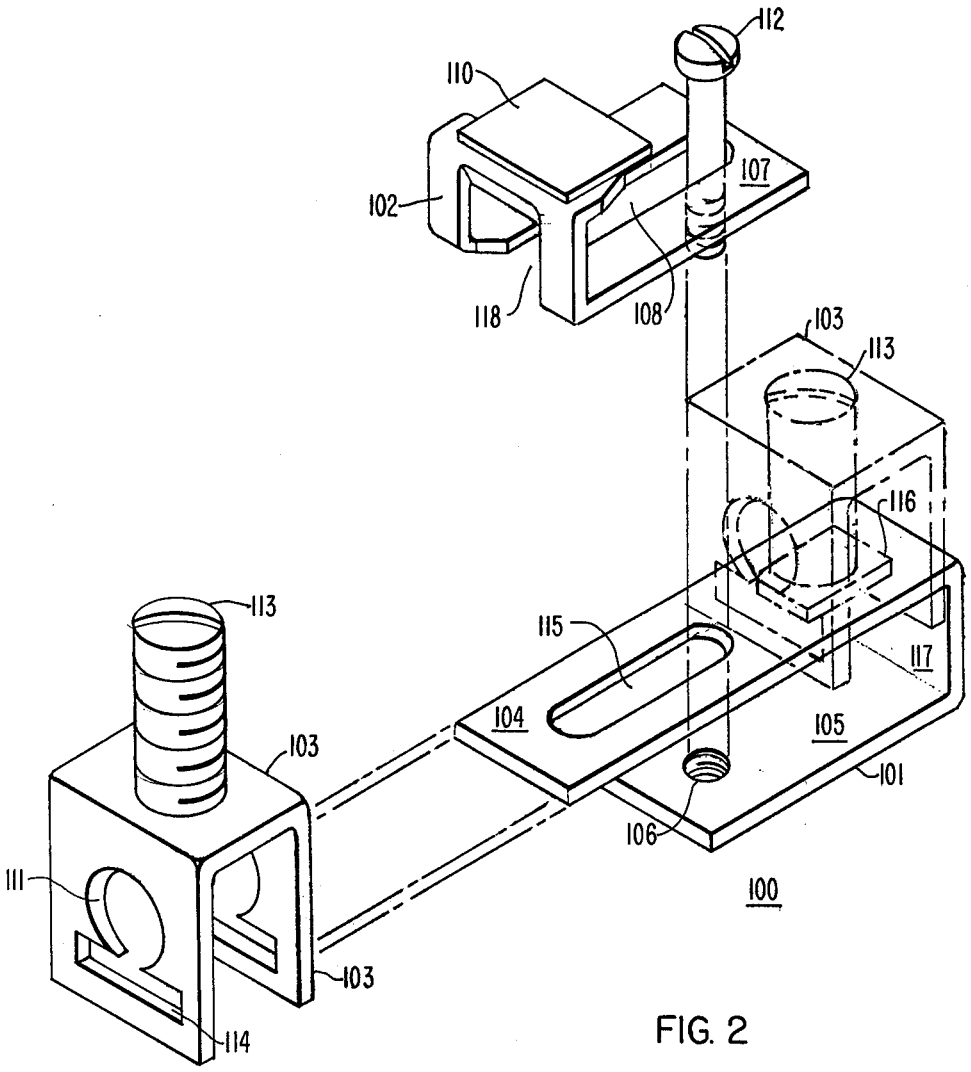
FIG. 2 shows an exploded perspective view of the stationary contact combination.
Figure 6:
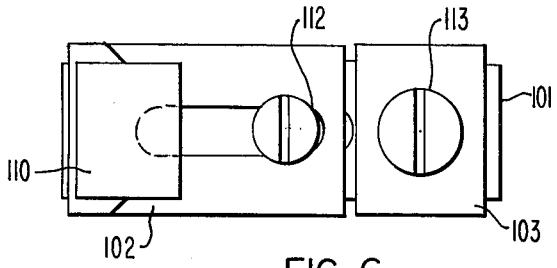
FIG. 6 shows a top view of the stationary contact assembly.
Figure 3:
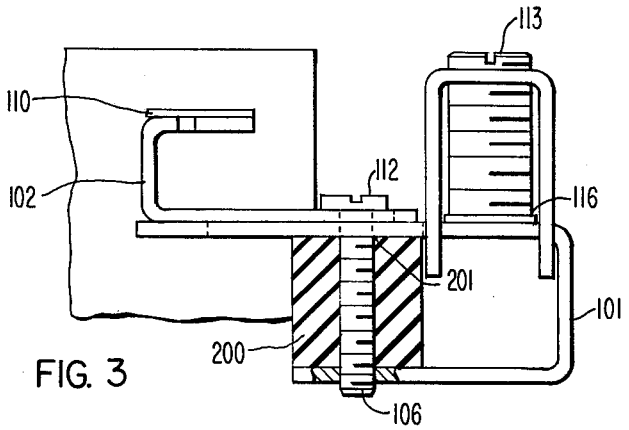
FIG. 3 shows a side elevational view of the stationary contact assembly in its normal operating position.
Figure 4:
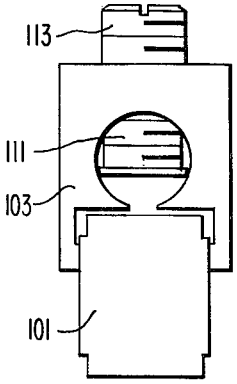
FIG. 4 shows an end view of the stationary contact assembly.

Referring now to FIG. 2 the contact combination 100, consists of five separable elements, namely, the terminal assembly 101, the contact carrier 102 having stationary contact 110 welded or otherwise fixed securely thereon, the terminating collar 103, the holding screw 112, and the screw lug 113. The terminal assembly 101 has generally a U-shaped configuration. Said assembly is comprised of a bottom member 105 having a thread opening 106 and a top member 104 having an elongated slot 115. When the terminal assembly 101 is inserted into the insulating housing of the contactor, the insulating contact plate 200 slides into the bight portion of the terminal assembly with the bottom member 105 going underneath said plate and the upper member 104 resting upon the contact plate. The termination collar 103 has a modified tubular configuration with the top member comprising a threaded opening for a screw lug 113 with a pressure plate 116. The front and back members are each comprised of a convolute opening 111 with a rectangular slot 114 interconnected to said opening. Prior to inserting the terminal assembly into the contactor housing the termination collar 103 is first inserted over the top member 105 through the rectangular slot 114 until it reaches the back member 117 of the terminal assembly as shown in FIG. 2. Referring now to FIGS. 3 and 6 the terminal assembly is then inserted upon the insulating contact plate in such a manner that the threaded opening 106 of the bottom member 105 is aligned with an opening 201 of the insulating contact plate. Once this alignment has been made the contact carrier 102 is then placed upon the top member 105 of the terminal assembly in such a manner that the contact carrier would be in its normal operating position. The contact carrier 102 is also a generally U-shaped assembly with its bottom member 107 having an elongated slot 108 which extends and is connected to a back window-like opening 118 as shown in FIG. 2. The holding screw 112 is then placed through the slot in the contact carrier, through the elongated slot of the terminal assembly, through the opening in the insulating mounting plate, and finally into the threaded opening 106 of the bottom member of the terminal assembly. The holding screw 112 is then tightened supplying contact pressure between the contact carrier 102 and the terminal assembly 101 and also securing the terminal assembly in its normal operating position by interlocking it with the insulating contact plate by means of the threaded screw 112. Electrical conductors can then be terminated at the terminal assembly by inserting the electrical wire into the convolute opening 111. Pressure is then supplied to the conductors by the terminal lug 113 and the pressure plate 116. When pressure is applied by the terminal lug 113 the conductors are securely held within the confines of the convolute opening 111 as the material expands to escape the applied pressure, see FIG. 4.

Figure 5:
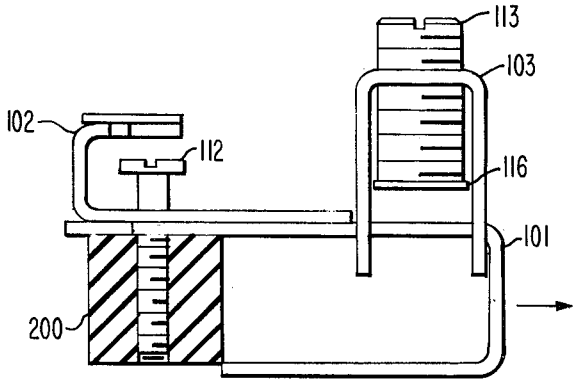
FIG. 5 shows a side elevational view of the stationary contact assembly in its withdrawn position.

In order to inspect the contact or to remove the contact carrier once the terminal combination is in its normal operating position the holding screw 112 needs only to be loosened until it is free from the threaded opening 106. The terminal assembly 101 can then be slid away from the insulating contact plate 200 with the contact carrier 102 mounted thereon. Therefore, as shown in FIG. 5 without removing the electrical conductors from the terminal assembly the contact 110 can easily be inspected, and in order to remove the contact carrier for its replacement the contact carrier 102 need only be lifted from the terminal assembly 101 with the head of the holding screw 112 passing through the window opening 118. A new contact carrier can then be replaced by simply passing holding screw head 112 through the window opening 118 placing the contact carrier upon the terminal assembly and then sliding the terminal assembly 105 back into alignment with the opening 201 in the insulating contact plate. The screw 112 is then retightened thus securing the contact carrier to the terminal assembly and interlocking the terminal assembly to the insulating contact plate.

What we claim is:

1. An electric control device, comprising a housing, a control device structure supported on the housing, said control device structure comprising a contact combination, said contact combination comprising a separable pull-out terminal assembly having at one end a separable pull-out contact carrier with a stationary contact mounted thereon, a separable terminating collar with a convolute opening for securing electrical conductors mounted at its other end, and said separable pull-out terminal assembly cooperating with said separable terminating collar to allow individual removal of said separable pull-out contact carrier without removal of said electrical conductors from said separable terminating collar or removal of said separable pull-out terminal assembly from said housing.

2. An electric control device as recited in claim 1, whereby said pull-out terminal assembly is comprised of a generally U-shaped configuration having a top member and a bottom member, said top member comprising an elongated slot which provides for withdrawal of the pull-out terminal assembly from the housing, said housing having an opening therein, and is disposed to allow individual removal of said separable pull-out contact carrier, said bottom member having a threaded opening, and a holding screw which passes through said elongated slot in the terminal assembly, the opening in said housing, and said threaded opening in the bottom member of the terminal assembly to interlock the pull-out terminal assembly to the housing.

3. An electric control device as recited in claim 1, whereby said separable pull-out contact carrier being a generally U-shaped member and comprising a bottom segment having an elongated slot therein, a bight segment having an opening therein which is a continuation of said elongated slot, a top segment having a stationary contact mounted thereon, and said separable pull-out contact carrier is disposed to be individually removed from said contact combination.

4. An electric control device as recited in claim 1, said collar comprising a front face and a rear face, the front face and rear face being disposed to securely hold electrical conductors, a screw lug with a pressure plate affixed thereto disposed to apply pressure to securely hold electrical conductors, and an elongated slot for mounting the collar on the terminal assembly.

* * * * *